US009969956B2

(12) United States Patent
Braeckman et al.

(10) Patent No.: US 9,969,956 B2
(45) Date of Patent: May 15, 2018

(54) LIQUID DETERGENT COMPOSITION

(71) Applicant: The Procter & Gamble Company, Cincinnati, OH (US)

(72) Inventors: Karl Ghislain Braeckman, Gerpinnes (BE); Bjorn Van Overstraete, Melle (BE)

(73) Assignee: The Procter & Gamble Company, Cincinnati, OH (US)

( * ) Notice: Subject to any disclaimer, the term of this patent is extended or adjusted under 35 U.S.C. 154(b) by 89 days.

(21) Appl. No.: 14/962,023

(22) Filed: Dec. 8, 2015

(65) Prior Publication Data

US 2016/0177224 A1 Jun. 23, 2016

(30) Foreign Application Priority Data

Dec. 19, 2014 (EP) ..... 14199396

(51) Int. Cl.

| | |
|---|---|
| ***C11D 1/29*** | (2006.01) |
| ***C11D 1/75*** | (2006.01) |
| ***C11D 1/83*** | (2006.01) |
| ***C11D 1/02*** | (2006.01) |
| ***C11D 1/14*** | (2006.01) |

(52) U.S. Cl.

CPC ..... *C11D 1/75* (2013.01); *C11D 1/02* (2013.01); *C11D 1/14* (2013.01); *C11D 1/29* (2013.01); *C11D 1/83* (2013.01); *C11D 1/8305* (2013.01); *C11D 1/146* (2013.01)

(58) Field of Classification Search

CPC .... C11D 1/02; C11D 1/14; C11D 1/29; C11D 1/75; C11D 1/83; B08B 3/04

USPC ..... 510/237, 427, 503; 134/25.2

See application file for complete search history.

(56) References Cited

U.S. PATENT DOCUMENTS

| | | | |
|---|---|---|---|
| 2003/0121530 | A1 | 7/2003 | Borgonjon et al. |
| 2006/0019851 | A1 | 1/2006 | Hecht et al. |
| 2013/0072410 | A1 | 3/2013 | Germain et al. |

FOREIGN PATENT DOCUMENTS

| | | | |
|---|---|---|---|
| GB | 2 292 562 | A | 2/1996 |
| WO | WO 95/03383 | A1 | 2/1995 |

OTHER PUBLICATIONS

EP Search Report dated Jun. 3, 2015; 6 pages, Application No. 14199396.4.

*Primary Examiner* — Gregory R Delcotto

(74) *Attorney, Agent, or Firm* — Lauren Christine Gonzalez; Abbey A. Lopez

(57) ABSTRACT

A hand dishwashing detergent composition comprising anionic surfactant and from about 2% to about 15% by weight of the composition of amine oxide surfactant comprising a) from about 10% to about 45% by weight of the amine oxide of low-cut amine oxide of formula R1R2R3AO wherein R1 and R2 are selected from hydrogen, C1-C4 alkyls and mixtures thereof and wherein R3 is selected from C10 alkyls and mixtures thereof; and b) from 55% to 90% by weight of the amine oxide of mid-cut amine oxide of formula R4R5R6AO wherein R4 and R5 are selected from hydrogen, C1-C4 alkyls and mixtures thereof and wherein R6 is selected from C12-C16 alkyls and mixtures thereof.

7 Claims, No Drawings

LIQUID DETERGENT COMPOSITION

FIELD OF THE INVENTION

The present invention relates to a hand dishwashing detergent composition comprising anionic surfactant and a low-cut amine oxide. The composition provides improved cleaning and foaming properties and present good stability.

BACKGROUND OF THE INVENTION

Hand dishwashing detergent compositions should have a good suds profile while providing good soil and grease cleaning.

Users usually see foam as an indicator of the performance of the detergent composition. Moreover, the user of a hand dishwashing detergent composition also uses the sudsing profile and the appearance of the foam (density, whiteness) as an indicator that the wash solution or cleaning implement still contains active detergent ingredients. The user usually doses the dishwashing detergent depending on the foam ability and renews the wash solution when the suds subsides or when the foam does not look strong enough. Thus, a wash liquor comprising a dishwashing detergent composition that generates little foam would tend to be replaced by the user more frequently than it is necessary. Hand dishwashing detergent compositions need to exhibit good foam height and appearance as well as good foam generation during the initial mixing of the detergent with water and good lasting foam during the entire manual dishwashing operation.

There is a need to provide hand dishwashing compositions with improved foam properties while at the same time providing good cleaning.

SUMMARY OF THE INVENTION

According to a first aspect of the invention, there is provided a hand dishwashing detergent composition. The composition comprises anionic surfactant and amine oxide surfactant. The composition comprises from about 2 to about 15%, preferably from 3 to about 15% by weight of the composition of amine oxide surfactant. The amine oxide surfactant is a mixture of amine oxides comprising a low-cut amine oxide and a mid-cut amine oxide.

The amine oxide of the composition of the invention comprises:

a) from about 10% to about 45% by weight of the amine oxide of low-cut amine oxide of formula R1R2R3AO wherein R1 and R2 are selected from hydrogen, C1-C4 alkyls and mixtures thereof and wherein R3 is selected from C10 alkyls and mixtures thereof; and b) from 55% to 90% by weight of the amine oxide of mid-cut amine oxide of formula R4R5R6AO wherein R4 and R5 are selected from hydrogen, C1-C4 alkyls and mixtures thereof and wherein R6 is selected from C12-C16 alkyls and mixtures thereof The composition of the invention provides good cleaning and good suds profile. It presents benefits in terms of tough food cleaning (cooked-, baked- and burnt-on soils) and grease cleaning.

When the composition of the invention is in use, the appearance of the suds is very appealing. The suds are constituted by airy bubbles that seem to travel very quickly from the cleaning implement to the items to be cleaned. This is believed to contribute to a faster and better cleaning.

Compositions comprising from 12.5% to about 40% by weight of the amine oxide of the low-cut amine oxide have been found optimum in terms of cleaning and suds. Although the compositions of the invention can comprise from 10% to 45% by weight of the amine oxide of low-cut amine oxide, it has been found that the cleaning and suds benefits conferred by the low cut amine oxide are optimum when the level of low cut amine oxide in the composition is from 12.5% to 40% by weight of the amine oxide. Additional benefits are obtained when the composition also comprises from about 60% to 87.5% by weight of the amine oxide of the mid-cut amine oxide.

In a preferred low-cut amine oxide for use herein R3 is n-decyl. In another preferred low-cut amine oxide for use herein R1 and R2 are both methyl. In an especially preferred low-cut amine oxide for use herein R1 and R2 are both methyl and R3 is n-decyl.

Preferably, the amine oxide comprises less than about 5%, more preferably less than 3% by weight of the amine oxide of an amine oxide of formula R7R8R9AO wherein R7 and R8 are selected from hydrogen, C1-C4 alkyls and mixtures thereof and wherein R9 is selected from C8 alkyls and mixtures thereof. Compositions comprising R7R8R9AO tend to be instable and do not provide very suds mileage.

The composition of the invention comprises anionic surfactant, the anionic surfactant can be any anionic cleaning surfactant, preferably the anionic surfactant comprises a sulphate anionic surfactant, more preferably an alkyl sulphate and/or alkoxylated sulfate anionic surfactant, preferably an alkyl alkoxylated sulphate, preferably the alkoxylated anionic surfactant has an average alkoxylation degree of from about 0.2 to about 3, preferably from about 0.2 to about 2, most preferably from about 0.2 to about 1.0. Also preferred are branched anionic surfactants having a weight average level of branching of from about 5% to about 40%.

Preferably the composition of the invention comprises from about 1% to about 60%, preferably from about 5% to about 50%, more preferably from about 8% to about 40% by weight of the composition of total surfactant. Preferably the composition of the invention comprises from about 5% to about 40% by weight of the composition of anionic surfactant, more preferably from about 8% to about 35%, yet more preferably from about 10% to about 30%.

Preferably the anionic surfactant and the amine oxide are in a weight ratio of from about 1:1 to about 10:1, preferably from about 2:1 to about 4:1. Compositions in which the anionic surfactant and the amine oxide surfactant are in these ratios present very good suds mileage.

Preferably, the composition of the invention comprises less than about 2%, more preferably less than 1% by weight of the composition of non-ionic surfactants. It has been found that the compositions with this low level of non-ionic surfactant can provide a more robust cleaning system.

According to the second aspect of the invention, there is provided a process for making the dishwashing detergent of the invention. The process requires the use of two different streams one comprising the low-cut amine oxide and another comprising the mid-cut amine oxide.

According to the third aspect of the invention, there is provided a method of manual dishwashing comprising the step of: delivering the detergent composition of the invention to a volume of water and immersing soiled dishware in the water. When the composition of the invention is used according to this method an excellent suds profile, with a long lasting effect is achieved.

For the purpose of this invention "dishware" herein includes cookware and tableware.

DETAILED DESCRIPTION OF THE INVENTION

The present invention envisages a hand dishwashing detergent composition. Preferably in liquid form. The detergent composition comprises a surfactant system comprising anionic and amine oxide surfactant. It provides very good cleaning, especially grease cleaning. It is also good for tough food cleaning, including cook-, baked- and burnt-on cleaning. It provides a very good suds mileage and suds profile.

The Detergent Composition

The detergent composition is a hand dishwashing detergent, preferably in liquid form. It typically contains from 30% to 95%, preferably from 40% to 90%, more preferably from 50% to 85% by weight of the composition of a liquid carrier in which the other essential and optional components are dissolved, dispersed or suspended. One preferred component of the liquid carrier is water.

Preferably the pH of the composition is adjusted to between 3 and 14, more preferably between 4 and 13, more preferably between 6 and 12 and most preferably between 8 and 10. The pH is measured as a 10 wt % product solution in deionised water at 20° C. The pH of the composition can be adjusted using pH modifying ingredients known in the art.

The composition can comprises 1% to 60%, preferably from 5% to 50%, more preferably from 8% to 40% of total surfactant. In addition to the anionic and amine oxide surfactant the composition can optionally comprise non-ionic surfactant, zwitterionic and/or cationic surfactant.

Amine Oxide Surfactant

The amine oxide surfactant improves the cleaning and boosts the suds of the detergent composition. This improved cleaning and suds boosting is achieved by the combination of the anionic surfactant and amine oxide and the presence of low cut amine oxide surfactant at the claimed level.

Low-Cut Amine Oxide

Within the meaning of the present invention "low-cut amine oxide" means an amine oxide in which at least 90%, preferably at least 95% and more preferably at least 98% and especially at least 100% of the cut has the formula: R1R2R3AO wherein R1 and R2 are selected from hydrogen, C1-C4 alkyls and mixtures thereof and wherein R3 is selected from C10 alkyls and mixtures thereof.

Mid-Cut Amine Oxide

Within the meaning of the present invention "mid-cut amine oxide" means an amine oxide in which at least 90%, preferably at least 95% and more preferably at least 98% and especially at least 100% of the cut has the formula: R4R5R6AO wherein R4 and R5 are selected from hydrogen, C1-C4 alkyls and mixtures thereof and wherein R6 is selected from C12-C16 alkyls and mixtures thereof.

Anionic Surfactant

Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group preferably selected from sulfonate, sulfate, and carboxylate so as to form a water-soluble compound.

Usually, the hydrophobic group will comprise a C8-C22 alkyl, or acyl group. Such surfactants are employed in the form of water-soluble salts and the salt-forming cation usually is selected from sodium, potassium, ammonium, magnesium and mono-, di- or tri-alkanolammonium, with the sodium, cation being the usual one chosen.

The anionic surfactant can be a single surfactant but usually it is a mixture of anionic surfactants. Preferably the anionic surfactant comprises a sulphate surfactant, more preferably a sulphate surfactant selected from the group consisting of alkyl sulphate, alkyl alkoxy sulphate and mixtures thereof. Preferred alkyl alkoxy sulphates for use herein are alkyl ethoxy sulphates.

Preferably the anionic surfactant is alkoxylated, more preferably, an alkoxylated branched anionic surfactant having an alkoxylation degree of from about 0.2 to about 4, even more preferably from about 0.3 to about 3, even more preferably from about 0.4 to about 1.5 and especially from about 0.4 to about 1. Preferably, the alkoxy group is ethoxy. When the branched anionic surfactant is a mixture of surfactants, the alkoxylation degree is the weight average alkoxylation degree of all the components of the mixture (weight average alkoxylation degree). In the weight average alkoxylation degree calculation the weight of anionic surfactant components not having alkoxylated groups should also be included.

Weight average alkoxylation degree=
($x1$*alkoxylation degree of surfactant 1+$x2$*alkoxylation degree of surfactant 2+ . . . )/($x1$+$x2$+ . . . )

wherein x1, x2, . . . are the weights in grams of each anionic surfactant of the mixture and alkoxylation degree is the number of alkoxy groups in each anionic surfactant.

Preferably the anionic surfactant to be used in the detergent of the present invention is a branched anionic surfactant having a level of branching of from about 5% to about 40%, preferably from about 10 to about 35% and more preferably from about 20% to about 30%. Preferably, the branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the anionic surfactant used in the detergent of the invention. Most preferably the branched anionic surfactant is selected from alkyl sulphates, alkyl ethoxy sulphates, and mixtures thereof.

The branched anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

Weight average of branching (%)=[($x1$*wt % branched alcohol 1 in alcohol 1+$x2$*wt % branched alcohol 2 in alcohol 2+ . . . )/($x1$+$x2$+ . . . )]*100 wherein x1, x2, . . . are the weight in grams of each alcohol in the total alcohol mixture of the alcohols which were used as starting material for the anionic surfactant for the detergent of the invention. In the weight average branching degree calculation the weight of anionic surfactant components not having branched groups should also be included.

Preferably, the anionic surfactant is a branched anionic surfactant having a level of branching of from about 5% to about 40%, preferably from about 10 to about 35% and more preferably from about 20% to about 30%, more preferably the branched anionic surfactant comprises more than 50% by weight thereof of an alkyl ethoxylated sulphate. Preferably the branched anionic surfactant has an average ethoxylation degree of from about 0.2 to about 3 and preferably an average level of branching of from about 5% to about 40%.

Preferably, the anionic surfactant comprises at least 50%, more preferably at least 60% and preferably at least 70% by weight of the anionic surfactant, more preferably the branched anionic surfactant comprises more than 50% by weight thereof of an alkyl ethoxylated sulphate having an ethoxylation degree of from about 0.2 to about 3 and preferably a level of branching of from about 5% to about 40%.

Sulphate Surfactants

Suitable sulphate surfactants for use herein include water-soluble salts of C8-C18 alkyl or hydroxyalkyl, sulphate and/or ether sulfate. Suitable counterions include alkali metal cation or ammonium or substituted ammonium, but preferably sodium.

The sulphate surfactants may be selected from C8-C18 primary, branched chain and random alkyl sulphates (AS); C8-C18 secondary (2,3) alkyl sulphates; C8-C18 alkyl alkoxy sulphates (AExS) wherein preferably x is from 1-30 in which the alkoxy group could be selected from ethoxy, propoxy, butoxy or even higher alkoxy groups and mixtures thereof.

Alkyl sulfates and alkyl alkoxy sulfates are commercially available with a variety of chain lengths, ethoxylation and branching degrees. Commercially available sulphates include, those based on Neodol alcohols ex the Shell company, Lial—Isalchem and Safol ex the Sasol company, natural alcohols ex The Procter & Gamble Chemicals company.

Preferably, the branched anionic surfactant comprises at least 50%, more preferably at least 60% and especially at least 70% of a sulphate surfactant by weight of the branched anionic surfactant. Especially preferred detergents from a cleaning view point art those in which the branched anionic surfactant comprises more than 50%, more preferably at least 60% and especially at least 70% by weight thereof of sulphate surfactant and the sulphate surfactant is selected from the group consisting of alkyl sulphate, alkyl ethoxy sulphates and mixtures thereof. Even more preferred are those in which the branched anionic surfactant has a degree of ethoxylation of from about 0.2 to about 3, more preferably from about 0.3 to about 2, even more preferably from about 0.4 to about 1.5, and especially from about 0.4 to about 1 and even more preferably when the anionic surfactant has a level of branching of from about 10% to about 35%, %, more preferably from about 20% to 30%.

Sulphonate Surfactants

Suitable sulphonate surfactants for use herein include water-soluble salts of C8-C18 alkyl or hydroxyalkyl sulphonates; C11-C18 alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). Those also include the paraffin sulphonates may be monosulphonates and/or disulphonates, obtained by sulphonating paraffins of 10 to 20 carbon atoms. The sulfonate surfactant also include the alkyl glyceryl sulphonate surfactants.

Nonionic surfactant, when present, is comprised in an amount of less than 2%, preferably less than 1% by weight of the composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol. Highly preferred nonionic surfactants are the condensation products of guerbet alcohols with from 2 to 18 moles, preferably 2 to 15, more preferably 5-12 of ethylene oxide per mole of alcohol.

Zwitterionic Surfactant

Other suitable surfactants include betaines, such as alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R_3)—(CH_2)_m—[CH(OH)—CH_2]_y—Y— \quad (I)$$

wherein $R^1$ is a saturated or unsaturated C6-22 alkyl residue, preferably C8-18 alkyl residue, in particular a saturated C10-16 alkyl residue, for example a saturated C12-14 alkyl residue;

X is NH, $NR^4$ with C1-4 Alkyl residue $R^4$, O or S, n a number from 1 to 10, preferably 2 to 5, in particular 3, x 0 or 1, preferably 1, $R^2$, $R^3$ are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, $OPO(OR^5)O$ or $P(O)(OR^5)O$, whereby $R^5$ is a hydrogen atom H or a C1-4 alkyl residue.

Preferred betaines are the alkyl betaines of the formula (Ia), the alkyl amido propyl betaine of the formula (Ib), the Sulfo betaines of the formula (Ic) and the Amido sulfobetaine of the formula (Id);

$$R^1—N^+(CH_3)_2—CH_2COO^- \quad (Ia)$$

$$R^1—CO—NH(CH_2)_3—N^+(CH_3)_2—CH_2COO^- \quad (Ib)$$

$$R^1—N^+(CH_3)_2—CH_2CH(OH)CH_2SO_3— \quad (Ic)$$

$$R^1—CO—NH—(CH_2)_3—N^+(CH_3)_2—CH_2CH(OH)CH_2SO_3— \quad (Id)$$

in which $R^11$ as the same meaning as in formula I. Particularly preferred betaines are the Carbobetaine [wherein $Y^-=COO^-$], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, Cocoamidopropylbetain.

The detergent composition herein may comprise a number of optional ingredients such as builders, chelants, conditioning polymers, cleaning polymers, surface modifying polymers, soil flocculating polymers, structurants, emollients, humectants, skin rejuvenating actives, enzymes, carboxylic acids, scrubbing particles, bleach and bleach activators, perfumes, malodor control agents, pigments, dyes, opacifiers, beads, pearlescent particles, microcapsules, inorganic cations such as alkaline earth metals such as Ca/Mg-ions, antibacterial agents, preservatives and pH adjusters and buffering means.

Method of Washing

Other aspects of the invention are directed to a method of washing dishware with the composition of the present invention.

The composition herein can be applied in its diluted form. Soiled dishes are contacted with an effective amount, typically from about 0.5 ml to about 20 ml (per about 25 dishes being treated), preferably from about 3 ml to about 10 ml, of the detergent composition, preferably in liquid form, of the present invention diluted in water. The actual amount of detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. Generally, from about 0.01 ml to about 150 ml, preferably from about 3 ml to about 40 ml of a liquid detergent composition of the invention is combined with from about 2000 ml to about 20000 ml, more typically from about 5000 ml to about 15000 ml of water in a sink having a volumetric capacity in the range of from about 1000 ml to about 20000 ml, more typically from about 5000 ml to about 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from about 1 to about 10 seconds, although the actual time will vary with each application and user. The contacting of cloth, sponge, or similar article to the dish surface is preferably accompanied by a concurrent scrubbing of the dish surface.

Another method may comprise immersing the soiled dishes into a water bath or held under running water without any liquid dishwashing detergent. A device for absorbing liquid dishwashing detergent, such as a sponge, is placed directly into contact with a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

Alternatively, the device may be immersed in a mixture of the hand dishwashing composition and water prior to being contacted with the dish surface, the concentrated solution is made by diluting the hand dishwashing composition with water in a small container that can accommodate the cleaning device at weight ratios ranging from about 95:5 to about 5:95, preferably about 80:20 to about 20:80 and more preferably about 70:30 to about 30:70, respectively, of hand dishwashing liquid:water respectively depending upon the user habits and the cleaning task.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

EXAMPLES

Evaluation of suds performance in hand dish detergent compositions

The suds performance of hand dishwashing detergent compositions (Examples A-G) was assessed under dilute conditions according to the protocol described herein. Suds mileage performance of different amine oxides (B-G) was assessed versus nil low cut amine oxide reference leg A at 35° C. in presence of 2 different greasy soils (detergent concentrations: soil 1:2000 ppm/soil 2:1200 ppm) across 3 different hardness conditions (2dH-15dH-30dH) and averaged. Legs B and C comprising n-C10 dimethylamine oxide within the most preferred range clearly showed the strongest suds mileage performance profile. n-C10 dimethylamine oxide also showed stronger performance compared to C8 and C12 analogue formulations (legs B and C versus leg A, F and G comparison). n-C8 dimethylamine oxide samples (legs F and G) also had stability issues, i.e. haziness was observed even at room temperature after making

| Level (as 100% active) | A | B | C | D | E |
|---|---|---|---|---|---|
| Sodium alkyl ethoxy sulfate | 22.91% | 22.91% | 22.91% | 22.91% | 22.91% |
| n-C12-14 Di Methyl Amine Oxide | 7.64% | 6.46% | 5.27% | 4.00% | 2.79% |
| n-C10 Di Methyl Amine Oxide (DMAO) | — | 1.18% | 2.37% | 3.64% | 4.85% |
| Lutensol XP80 (non-ionic surfactant supplied by BASF) | 0.45% | 0.45% | 0.45% | 0.45% | 0.45% |
| Sodium Chloride | 1.2% | 1.2% | 1.2% | 1.2% | 1.2% |
| Poly Propylene Glycol | 1% | 1% | 1% | 1% | 1% |

-continued

| | | | | | |
|---|---|---|---|---|---|
| Alkoxylated Polyethyleneimine | 0.5% | 0.5% | 0.5% | 0.5% | 0.5% |
| Ethanol | 2% | 2% | 2% | 2% | 2% |
| Sodium Hydroxide | 0.24% | 0.24% | 0.24% | 0.24% | 0.24% |
| Minors + water | To 100% | To 100% | To 100% | To 100% | To 100% |
| pH (@ 10% solution) | 9 | 9 | 9 | 9 | 9 |

| Level (as 100% active) | F | G |
|---|---|---|
| Sodium alkyl ethoxy sulfate | 22.91% | 22.91% |
| n-C12-14 Di Methyl Amine Oxide | 6.39% | 5.15% |
| n-C8 Di Methyl Amine Oxide | 1.25% | 2.49% |
| Lutensol XP80 (non-ionic surfactant supplied by BASF) | 0.45% | 0.45% |
| Sodium Chloride | 1.2% | 1.2% |
| Poly Propylene Glycol | 1% | 1% |
| Alkoxylated Polyethyleneimine | 0.5% | 0.5% |
| Ethanol | 2% | 2% |
| Sodium Hydroxide | 0.24% | 0.24% |
| Minors + water | To 100% | To 100% |
| pH (@ 10% solution) | 9 | 9 |

| | Suds mileage performance |
|---|---|
| Reference: leg A (nil low cut AO) | 100 |
| Leg B (1.17% n-C10 DMAO) | 106 |
| Leg C (2.37% n-C10 DMAO) | 106 |
| Leg D (3.64% n-C10-DMAO) | 101 |
| Leg E (4.85% n-C10-DMAO) | 102 |
| Leg F (1.25% n-C8-DMAO) | 96 |
| Leg G (2.49% n-C8-DMAO) | 89 |

DMAO: Di Methyl Amino Oxide

Soil Compositions

Soil 1:

| Ingredient | Weight % |
|---|---|
| Crisco oil | 12.730 |
| Crisco shortening | 27.752 |
| Lard | 7.638 |
| Refined Rendered Edible Beef Tallow | 51.684 |
| Oleic Acid, 90% (Techn) | 0.139 |
| Palmitic Acid, 99+% | 0.036 |
| Stearic Acid, 99+% | 0.021 |

Soil 2:

| Ingredient | Weight % |
|---|---|
| Zwan Flemish Carbonades | 22.67 |
| Beaten Eggs | 4.78 |
| Smash Instant Mash Potato | 9.26 |
| McDougall's Sponge Mix | 3.30 |
| Milk UHT Full Cream | 22.22 |
| Bisto Gravy Granules | 1.30 |
| Mazola Pure Corn Oil | 9.29 |
| Demineralized water | 26.32 |
| Sodium Benzoate | 0.42 |
| Potassium Sorbate | 0.42 |

Suds Mileage Testing Protocol:

The evolution of the foam volume generated by a certain solution of dishwashing liquid is followed at specified hardness, solution temperature and detergent concentrations, under influence of periodic soil injections. Data are compared and expressed versus a reference product as a suds mileage index (reference product has suds mileage index of 100).

A defined amount of dishwashing product depending on the targeted detergent concentration is dispensed through a pipet with a flow rate of 0.67 ml/sec at a height of 37 cm above the sink bottom surface into a water stream that starts filling up a sink (dimensions: cilinder—Diameter 300 mm & height 288 mm) to 4 L with a constant pressure of 4 bar. With this pressure an initial suds volume is generated in the sink.

After recording the initial foam volume (average foam height*sink surface area) a fixed amount of soil (6 ml) will be injected almost instantaneously in the middle of the sink, while a paddle (metal blade 10×5 cm, positioned in the middle of the sink at the air liquid interface under an angle of 45 degrees) will rotate 20 times into the solution at 85 rpm. This step is followed immediately by another measurement of the total suds volume. The soil injecting, paddling and measuring steps are repeated until the measured foam volume reaches a minimum level, which is set at 400 $cm^3$. The amount of soil additions needed to get to that level is considered as the mileage of that specific sample.

The complete process is repeated 4 times per sample and per testing condition (temperature, concentration, hardness, soil type). As a final result the average mileage of the 4 replicates is calculated for each sample and averaged across testing conditions. Comparing the average mileage of the test sample versus that of the reference sample, indicates the performance of the test sample versus that reference sample, and is expressed as a suds mileage index, calculated as (average number of soil additions of test sample/average number of soil additions of reference sample)*100.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hand dishwashing detergent composition comprising an anionic surfactant and from about 3% to about 8% by weight of the composition of an amine oxide surfactant comprising:

a) from 15% to 31% by weight of the amine oxide of a low-cut amine oxide of formula R1R2R3AO, wherein R1 and R2 are both methyl and R3 is n-decyl; and b) from 68% to 85% by weight of the amine oxide of mid-cut amine oxide of formula R4R5R6AO, wherein R4 and R5 are selected from hydrogen, C1-C4 alkyls and mixtures thereof, and wherein R6 is selected from C12-C14 alkyls and mixtures thereof;

c) wherein the anionic surfactant is an alkyl ethoxylated sulphate and wherein the amount of alkyl ethoxylated sulfate is from 10% to 30% by weight of the composition;

and wherein the weight ratio of the alkyl ethoxylated sulfate to the amine oxide surfactant is from about 2:1 to about 4:1.

2. A composition according to claim 1 comprising less than about 5% by weight of the amine oxide of an amine oxide of formula R7R8R9AO wherein R7 and R8 are selected from hydrogen, C1-C4 alkyls, and mixtures thereof, and wherein R9 is selected from C8 alkyls and mixtures thereof.

3. A composition according to claim 1 wherein the alkyl ethoxylated sulfate has comprises an alkoxylated anionic surfactant having an average ethoxylation degree of from about 0.2 to about 3.

4. A composition according to claim 1 wherein the weight ratio of the alkyl ethoxylated sulfate to the low-cut amine oxide surfactant is from about 5:1 to about 35:1.

5. A composition according to claim 1 wherein the composition comprises less than 2% by weight of the composition of any additional surfactants.

6. A process for making a hand dishwashing detergent composition according to claim 1 comprising the step of: delivering the low-cut and mid-cut amine oxide from different feed stocks.

7. A method of manually washing dishware comprising the step of: delivering a composition according to claim 1 to a volume of water to form a wash liquor and immersing the dishware in the liquor.

* * * * *